US006875928B1

(12) United States Patent
Hayes et al.

(10) Patent No.: US 6,875,928 B1
(45) Date of Patent: Apr. 5, 2005

(54) LOCAL AREA NETWORK CABLING ARRANGEMENT WITH RANDOMIZED VARIATION

(75) Inventors: Trent Hayes, McKinney, TX (US); Wayne Hopkinson, McKinney, TX (US)

(73) Assignee: Commscope Solutions Properties, LLC, Sparks, NV (US)

( * ) Notice: Subject to any disclaimer, the term of this patent is extended or adjusted under 35 U.S.C. 154(b) by 0 days.

(21) Appl. No.: 10/690,608

(22) Filed: Oct. 23, 2003

(51) Int. Cl.[7] ..... H01B 11/02
(52) U.S. Cl. ..... 174/113 R; 174/27
(58) Field of Search ..... 174/27, 113 R

(56) References Cited

U.S. PATENT DOCUMENTS 5,739,473 A * 4/1998 Zerbs ..... 174/121 A

FOREIGN PATENT DOCUMENTS

JP 6-349344 * 12/1994

* cited by examiner

*Primary Examiner*—Chau N. Nguyen
(74) *Attorney, Agent, or Firm*—Birch, Stewart, Kolasch & Birch, LLP

(57) ABSTRACT

A cabling media includes a plurality of twisted wire pairs housed inside a jacket. Each of the twisted wire pairs has a respective twist length, defined as a distance wherein the wires of the twisted wire pair twist about each other one complete revolution. At least one of the respective twist lengths purposefully varies along a length of the cabling media. In one embodiment, the cabling media includes four twisted wire pairs, with each twisted wire pair having its twist length purposefully varying along the length of the cabling media. Further, the twisted wire pairs may have a core strand length, defined as a distance wherein the twisted wire pairs twist about each other one complete revolution. In a further embodiment, the core strand length is purposefully varied along the length of the cabling media. The cabling media can be designed to meet the requirements of CAT 5, CAT 5*e* or CAT 6 cabling, and demonstrates low alien and internal crosstalk characteristics even at data bit rates of 10 Gbit/sec.

44 Claims, 11 Drawing Sheets

LOCAL AREA NETWORK CABLING ARRANGEMENT WITH RANDOMIZED VARIATION

RELATED APPLICATION DATA

This application is related to a co-pending application entitled "TIGHTLY TWISTED WIRE PAIR ARRANGEMENT FOR CABLING MEDIA," filed on Oct. 8, 2003, by the present inventors. The contents of this related application are hereby incorporated by reference.

BACKGROUND OF THE INVENTION

1. Field of the Invention

The present invention relates to a cabling media employing a plurality of twisted wire pairs. More particularly, the present invention relates to a twisting scheme for the twisted wire pairs constituting the cabling media, which allows for a relatively higher bit rate transmission, and reduces the likelihood of transmission errors due to alien and internal crosstalk.

2. Description of the Related Art

Along with the greatly increased use of computers for homes and offices, there has developed a need for a cabling media, which may be used to connect peripheral equipment to computers and to connect plural computers and peripheral equipment into a common network. Today's computers and peripherals operate at ever increasing data transmission rates. Therefore, there is a continuing need to develop cabling media, which can operate substantially error-free at higher bit rates, but also satisfy numerous elevated operational performance criteria, such as a reduction in alien crosstalk when the cable is in a high cable density application.

U.S. Pat. No. 5,952,607, which is incorporated herein by reference, discloses a typical twisting scheme employed in common twisted pair cables. FIG. 1 shows four pairs of wires (a first pair A, a second pair B, a third pair C and a fourth pair D) housed inside of a common jacket, constituting a first common cable E. In FIG. 1, the jacket has been partially removed at the end of the cable and the wire pairs A, B, C, D have been separated, so that the twist scheme can be clearly seen. FIG. 1 also illustrates a second common cable J, which is separate from the first common cable E, but identical in construction to the first common cable E. The second common cable J also includes four pairs of wires (a fifth pair F, a sixth pair G, a seventh pair H and an eight pair I) housed inside of a common jacket.

Each of the wire pairs A, B, C, D has a fixed twist interval a, b, c, d, respectively. Since the first and second common cables E and J are identical in construction, each of the wire pairs F, G, H, I also has the same fixed twist interval a, b, c, d, respectively. Each of the twist intervals a, b, c, d is different from the twist interval of the other wire pairs. As is known in the art, such an arrangement assists in reducing crosstalk between the wire pairs within the first common cable E. Further, as is common in the art, each of the twisted wire pairs has a unique fixed twist interval of slightly more than, or less than, 0.500 inches. The table below summarizes the twist interval ranges for the first through eight pairs A, B, C, D, F, G, H, I:

| Pair No. | Twist Length | Min. Twist Length | Max. Twist Length |
|---|---|---|---|
| A/F | 0.440 | 0.430 | 0.450 |
| B/G | 0.410 | 0.400 | 0.420 |
| C/H | 0.596 | 0.580 | 0.610 |
| D/I | 0.670 | 0.650 | 0.690 |

Cabling media with the twisting scheme outlined above, such as the cabling media disclosed in U.S. Pat. No. 5,952,607, have enjoyed success in the industry. However, with the ever-increasing demand for faster data rate transmission speeds, it has become apparent, that the cabling media of the background art suffers drawbacks. Namely, the background art's cabling media exhibits unacceptable levels of Alien near end crosstalk (ANEXT), at higher data transmission rates. FIGS. 2–5, illustrate the ANEXT for the wire pairs A, B, C, D of the cabling media, in accordance with the background art.

To measure the ANEXT of the pairs, an industry standard testing technique making use of a vector network analyzer (VNA) was employed. Briefly, to obtain the data of FIG. 2, the output of the VNA is connected to pair F of a cable J while the input of the VNA is connected to pair A of cable E. The VNA is used to sweep over a band of frequencies from 0.500 MHz to 1000 MHz and the ratio of the signal strength detected on pair A over the signal strength applied to pair F is captured. This is the ANEXT contributed to pair A in cable E from pair F in cable J. Contributions to pair A in cable E from pairs G, H and I in cable J are acquired in the same manner. The power sum of contributions from pairs F, G, H, and I in cable J to pair A in cable E is the ANEXT contributed to pair A in cable E due to all the pairs in cable J and is displayed as trace t1 in FIG. 2 on a logarithmic scale.

To obtain the traces t2 through t4 in the graphs of FIGS. 3–5, the above procedure is repeated for the second, third and fourth twisted wire pairs B, C, D in cable E. The graphs of FIGS. 2–5 illustrate the ANEXT for frequencies between 0.500 MHz and 1000 MHz. A reference line REF, described by the function 44.3−15*log(f/100) dB where f is in the units of MHz, is included in FIGS. 2–5 and serves as a reference, above which potentially acceptable ANEXT performance is achieved. Such tests are commonly used to verify the suitability of cabling media to surpass minimum standards and qualify as a cabling media, such as CAT 5, CAT 5*e*, and/or CAT 6. As can be seen in FIGS. 2–5, the ANEXT for the cabling media of the background art becomes unacceptable in that it crosses the reference line F at higher frequencies between 10 MHz and 200 MHz.

The reference line REF of FIGS. 2–5 will also serve to demonstrate the improved ANEXT performance of the present invention, as compared to the background art. The reference line REF is logarithmic but appears linear when plotted on a logarithmic scale and is described by the function 44.3−15*log(f/100) dB. The same reference line REF will be set forth in the performance graphs characterizing the present invention, and will provide a standard so that the performance results of the background art can be compared to performance results of the present invention.

SUMMARY OF THE INVENTION

It is an object of the present invention to provide a cabling media with improved internal and alien crosstalk performance, as compared to existing cabling media.

More specifically, it is an object of the present invention to develop a method of variation of twist length and strand length resulting in a cabling media employing multiple twisted wire pairs, wherein the variation in twist length along each of the included pairs and/or the strand length imparted on all four pairs reduces the internal and alien crosstalk levels of the cabling media.

These and other objects are accomplished by a cabling media including a plurality of twisted wire pairs housed inside a jacket. Each of the twisted wire pairs has respective twist lengths, defined as a distance wherein the wires of the twisted wire pair twist about each other one complete revolution. In this embodiment, the twist lengths of the twisted wire pairs vary along a portion of or along the entire length of the cabling media. In one embodiment, the cabling media includes four twisted wire pairs, with each twisted wire pair having its twist length varying along the length of the cabling media. The cabling media can be designed to meet the requirements of CAT 5, CAT 5*e* or CAT 6 cabling, and demonstrates low alien and internal crosstalk characteristics even at data bit rates of 10 Gbit/sec.

In accordance with the present invention, a cabling media, which is suitable for data transmission with relatively low crosstalk, includes a plurality of metallic conductors-pairs, each pair includes two plastic insulated metallic conductors which are twisted together. The characterization of the twisting is set by parameters such as twist length as well as core strand length/lay. For example, the twist length of one or more of the twisted wire pairs may be purposefully varied within a set range along the length of the cabling media. Further, the core strand length/lay may be purposefully varied within a set range along the length of the cabling media. Such parameters for the twist lengths and core strand length/lay are purposefully selected in order to achieve performance capabilities that significantly improve upon the alien crosstalk impairment that exists in present unshielded twisted pair (UTP) cables.

In one particular embodiment of this invention, a cable comprises as its transmission media, four twisted pair of individually insulated conductors with each of the insulated conductors including a metallic conductor and an insulation cover, which encloses the metallic conductor. The twisting together of the conductors of each pair is characterized as specifically set out herein and the plurality of transmission media are enclosed in a sheath system, which in a most simplistic embodiment may be a single jacket made of a plastic material. As a result of the particular twist scheme employed for the conductor pairs, operational performance criteria of the resulting cable is improved. Also, the cable of this invention is relatively easy to connect and is relatively easy to manufacture and install.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limits of the present invention, and wherein.

DETAILED DESCRIPTION OF A PREFERRED EMBODIMENT

Figure 1:
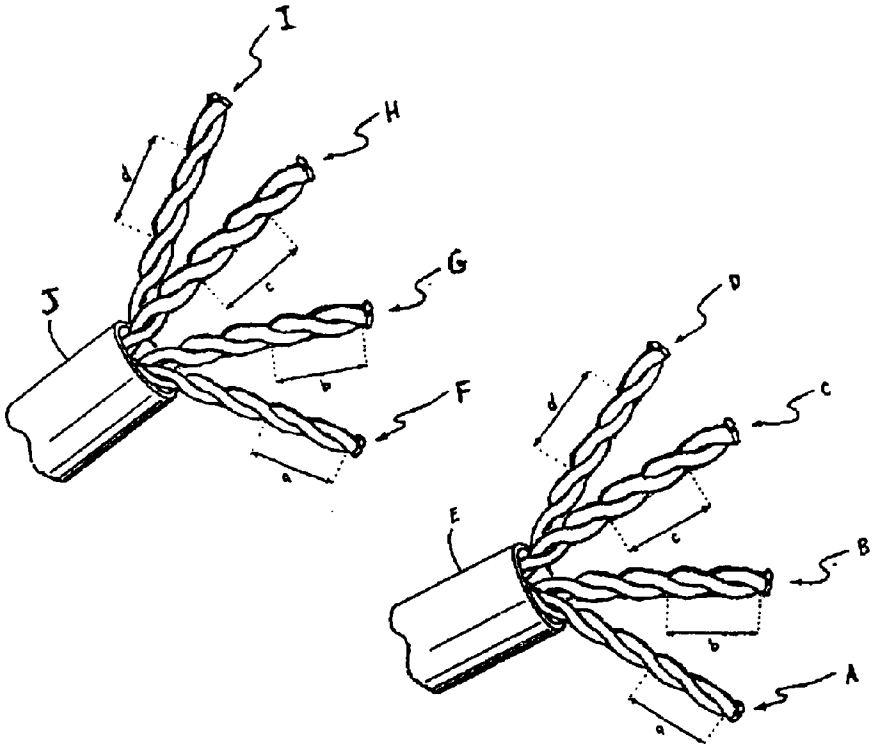
Figure 1 Background Art
FIG. 1 is a perspective view of two ends of two identical but separate cabling media having a jacket removed to show four twisted wire pairs, in accordance with the background art.
Figure 2:
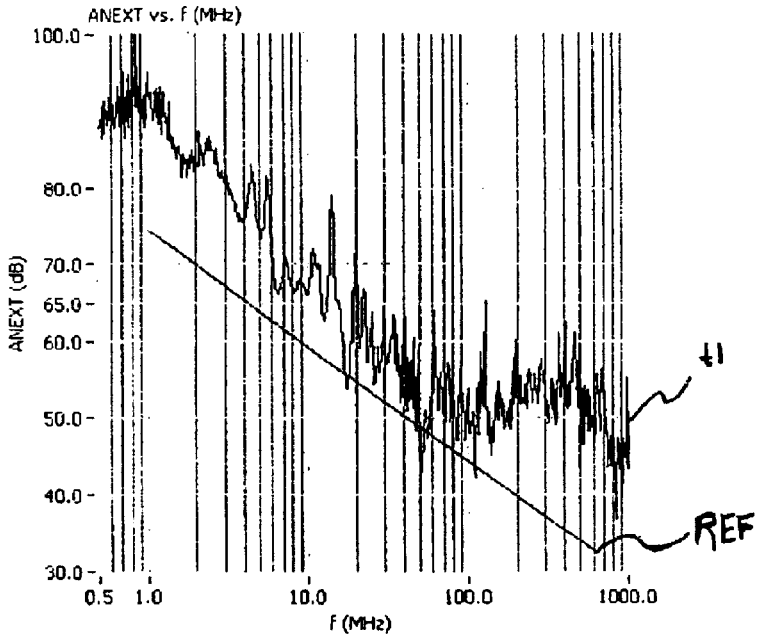
Figure 2 Background Art
FIG. 2 is a graph illustrating ANEXT performance of pair A in cable E due to contributions from pairs F, G, H and I in cable J in FIG. 1.
Figure 3:
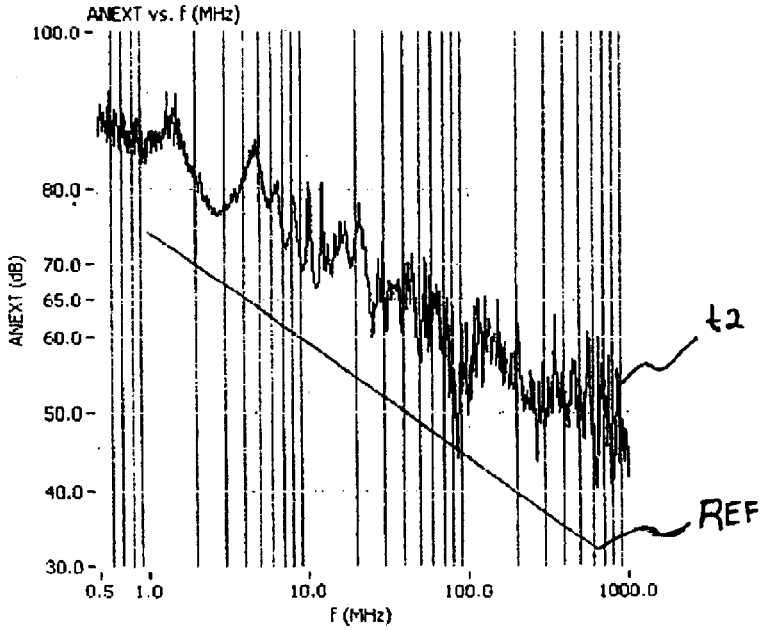
Figure 3 Background Art
FIG. 3 is a graph illustrating ANEXT performance of pair B in cable E due to contributions from pairs F, G, H and I in cable J in FIG. 1.
Figure 4:
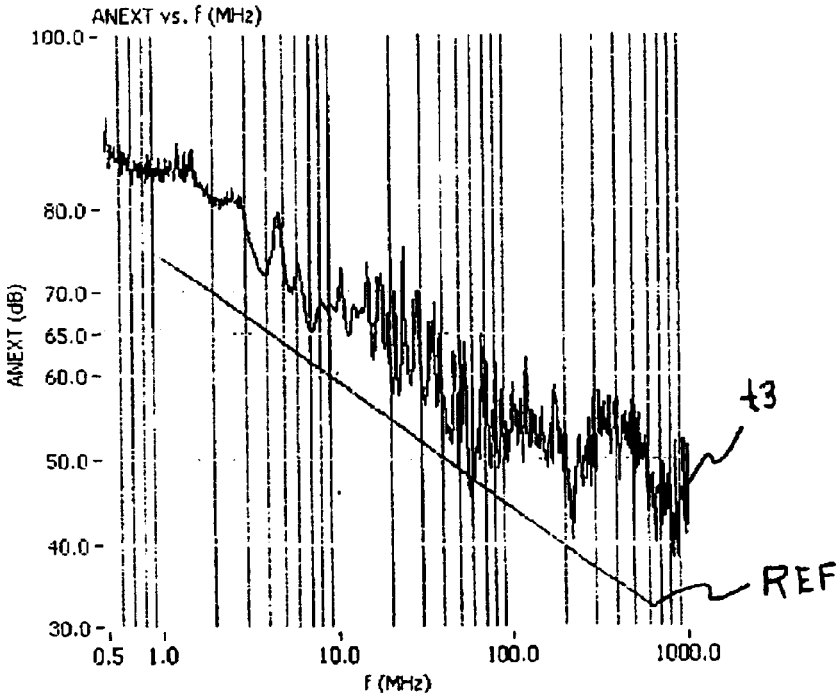
Figure 4 Background Art
FIG. 4 is a graph illustrating ANEXT performance of pair C in cable E due to contributions from pairs F, G, H and I in cable J in FIG. 1.
Figure 5:
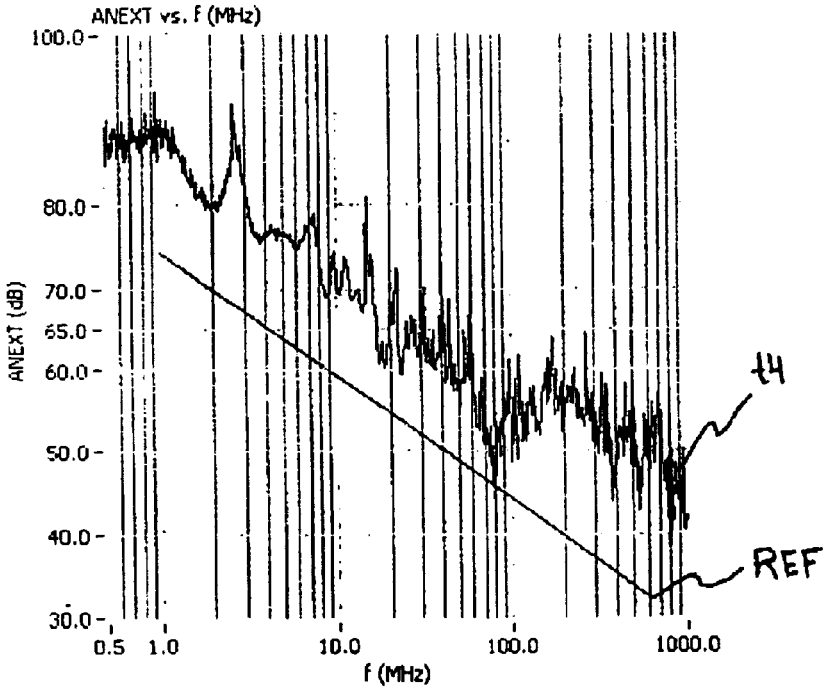
Figure 5 Background Art
FIG. 5 is a graph illustrating ANEXT performance of pair D in cable E due to contributions from pairs F, G, H and I in cable J in FIG. 1.
Figure 6:
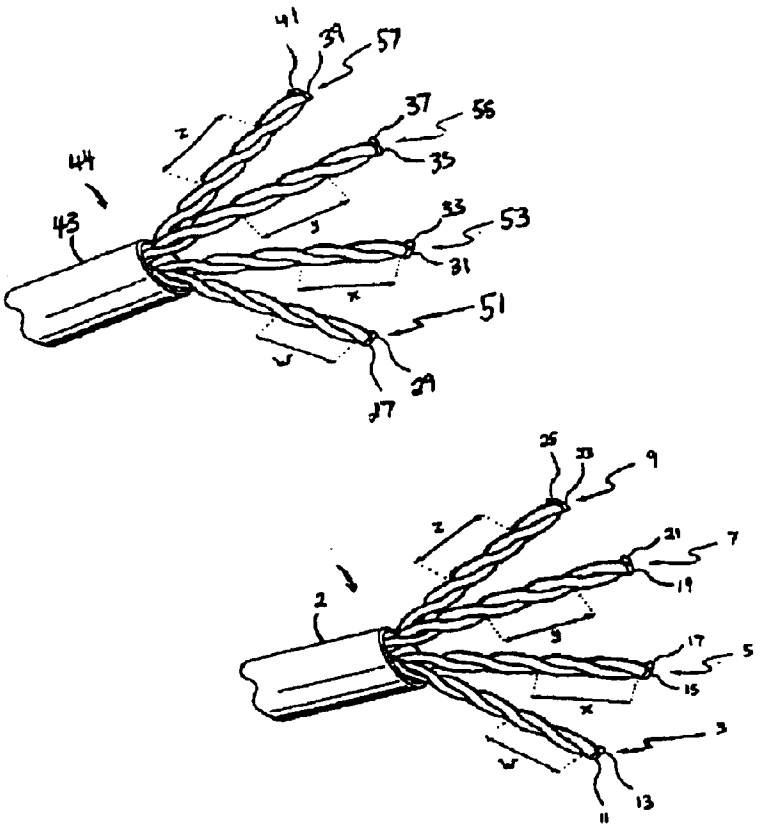
FIG. 6 is a perspective view of two ends of two identical but separate cabling media having a jacket removed to show four twisted wire pairs in each, in accordance with the present invention.
Figure 7:
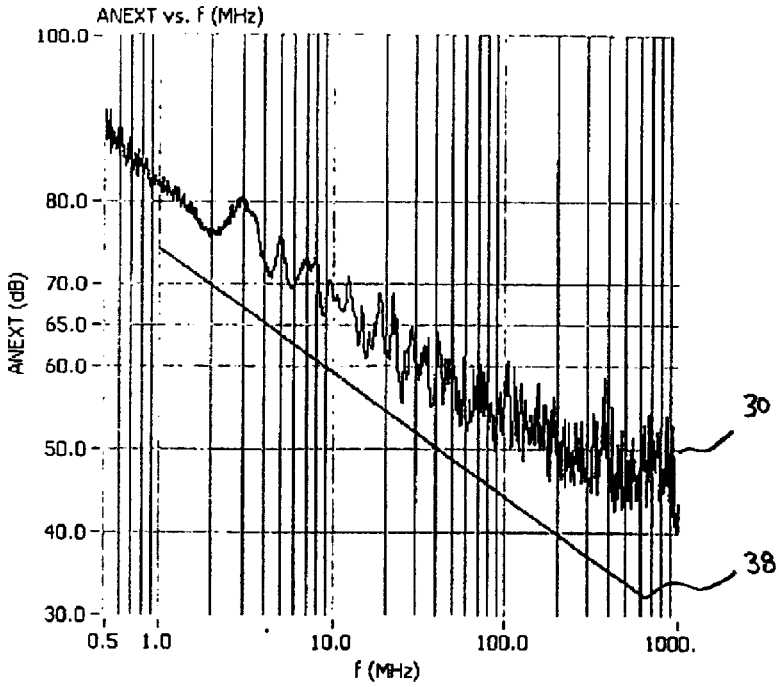
FIG. 7 is a graph illustrating ANEXT performance of a pair 3 of cable 1 in FIG. 6 due to contributions from pairs 51, 53, 55, and 57 in cable 44.
Figure 8:
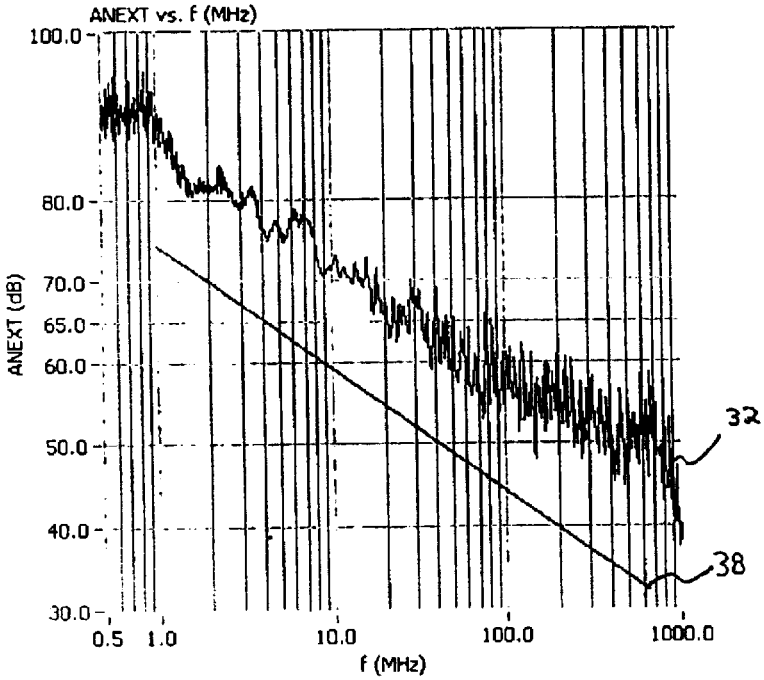
FIG. 8 is a graph illustrating ANEXT performance of a pair 5 of cable 1 in FIG. 6 due to contributions from pairs 51, 53, 55, and 57 in cable 44.
Figure 9:
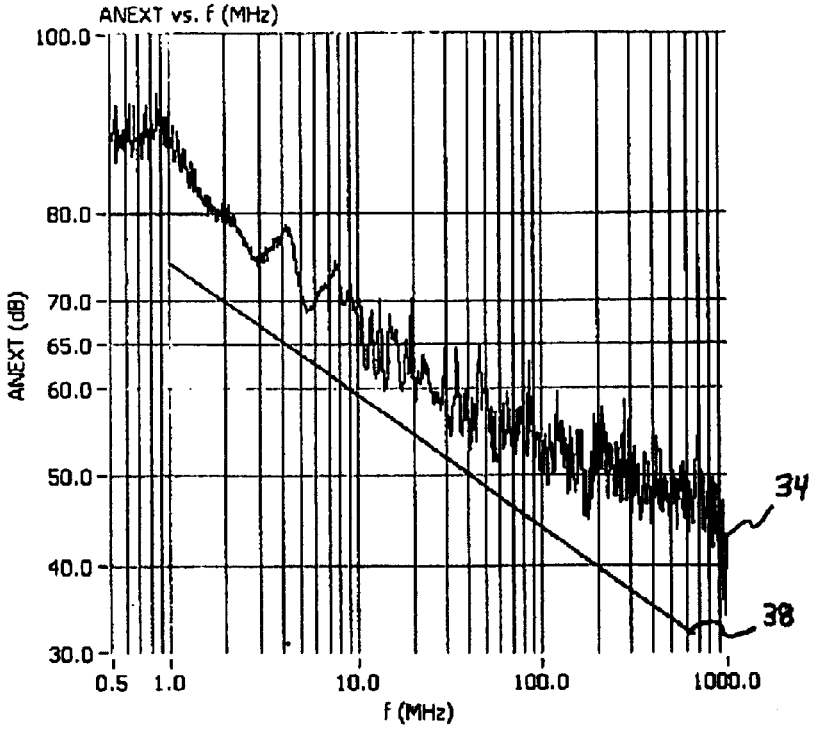
FIG. 9 is a graph illustrating ANEXT performance of a pair 7 of cable 1 in FIG. 6 due to contributions from pairs 51, 53, 55, and 57 in cable 44.
Figure 10:
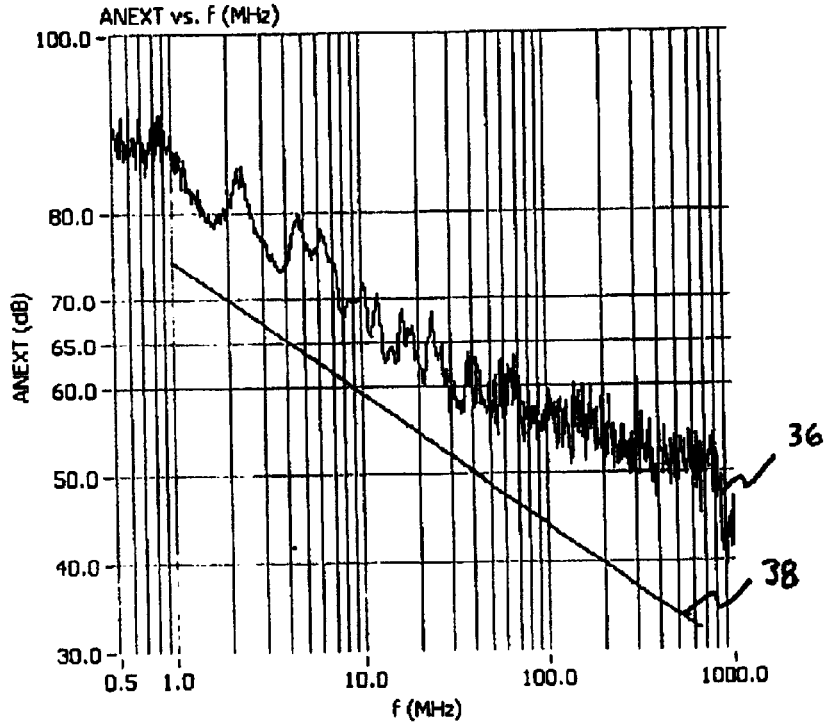
FIG. 10 is a graph illustrating ANEXT performance of a pair 9 of cable 1 in FIG. 6 due to contributions from pairs 51, 53, 55, and 57 in cable 44.

FIG. 6 illustrates two ends of two identical but separate cabling media, in accordance with the present invention. The end of a first cable 1 has a jacket 2 removed to show a plurality of twisted wire pairs and the end of a second cable 44 has a jacket 43 removed to show a similar plurality of twisted wire pairs. Specifically, the embodiment of FIG. 1 illustrates the first cable 1 having a first twisted wire pair 3, a second twisted wire pair 5, a third twisted wire pair 7, and a fourth twisted wire pair 9. Likewise, the second cable 44 includes a fifth twisted wire pair 51, a sixth twisted wire pair 53, a seventh twisted wire pair 55, and an eighth twisted wire pair 57.

Each twisted wire pair includes two conductors. Specifically, the first twisted wire pair 3 includes a first conductor 11 and a second conductor 13. The second twisted wire pair 5 includes a third conductor 15 and a fourth conductor 17. The third twisted wire pair 7 includes a fifth conductor 19 and a sixth conductor 21. The fourth twisted wire pair 9 includes a seventh conductor 23 and an eighth conductor 25. The fifth twisted wire pair 51 includes a ninth conductor 27 and a tenth conductor 29. The sixth twisted wire pair 53 includes an eleventh conductor 31 and a twelfth conductor 33. The seventh twisted wire pair 55 includes a thirteenth conductor 35 and a fourteenth conductor 37. The eighth twisted wire pair 57 includes a fifteenth conductor 39 and a sixteenth conductor 41.

Each of the conductors 11, 13, 15, 17, 19, 21, 23, 25, 27, 29, 31, 33, 35, 37, 39, 41 is constructed of an insulation layer surrounding an inner conductor. The outer insulation layer may be formed of a flexible plastic material having flame retardant and smoke suppressing properties. The inner conductor may be formed of a metal, such as copper, aluminum, or alloys thereof. It should be appreciated that the insulation layer and inner conductor may be formed of other suitable materials.

As illustrated in FIG. 6, each twisted wire pair is formed by having its two conductors continuously twisted around each other. For the first twisted wire pair 3, the first conductor 11 and the second conductor 13 twist completely about each other, three hundred sixty degrees, at a first interval w along the length of the first cable 1. The first interval w purposefully varies along the length of the first cable 1. For example, the first interval w could purposefully vary randomly within a first range of values along the length of the first cable 1. Alternatively, the first interval w could purposefully vary in accordance with an algorithm along the length of the first cable 1.

For the second twisted wire pair 5, the third conductor 15 and the fourth conductor 17 twist completely about each other, three hundred sixty degrees, at a second interval x along the length of the first cable 1. The second interval x purposefully varies along the length of the first cable 1. For example, the second interval x could purposefully vary randomly within a second range of values along the length of the first cable 1. Alternatively, the second interval x could purposefully vary in accordance with an algorithm along the length of the first cable 1.

For the third twisted wire pair 7, the fifth conductor 19 and the sixth conductor 21 twist completely about each other, three hundred sixty degrees, at a third interval y along the length of the first cable 1. The third interval y purposefully varies along the length of the first cable 1. For example, the third interval y could purposefully vary randomly within a third range of values along the length of the first cable 1. Alternatively, the third interval y could purposefully vary in accordance with an algorithm along the length of the first cable 1.

For the fourth twisted wire pair 9, the seventh conductor 23 and the eighth conductor 25 twist completely about each other, three hundred sixty degrees, at a fourth interval z along the length of the first cable 1. The fourth interval z purposefully varies along the length of the first cable 1. For example, the fourth interval z could purposefully vary randomly within a fourth range of values along the length of the first cable 1. Alternatively, the fourth interval z could purposefully vary in accordance with an algorithm along the length of the first cable 1.

The fifth through the eighth twisted wire pairs 51, 53, 55, 57 have the same purposefully varying twist intervals w, x, y, and z, because the second cable 44 is identically constructed as compared to the first cable 1. However, it should be noted that due to the randomness of the twist intervals it is remarkably unlikely that the twist intervals w, x, y, and z employed in the second cable 44 would have the same randomness of twists for the twisted wire pairs 51, 53, 55 57 as the twisted wire pairs 3, 5, 7, 9 of the first cable 1. Alternatively, if the twists of the twisted wire pairs are set by an algorithm, it would remarkably unlikely that a segment of the second cable 44 having the twisted wire pairs 51, 53, 55 57 cable 1 would lie alongside a segment of the first cable 1 having the same twist pattern of the twisted wire pairs 3, 5, 7, 9.

Each of the twisted wire pairs 3, 5, 7, 9, 51, 53, 55, 57 has a respective first, second, third and fourth mean value within the respective first, second, third and fourth ranges of values. In one embodiment, each of the first, second, third and fourth mean values of the intervals of twist w, x, y, z is unique. For example in one of many embodiments, the first mean value of the first interval of twist w is about 0.44 inches; the second mean value of second interval of twist x is about 0.41 inches; the third mean value of the third interval of twist y is about 0.59 inches; and the fourth mean value of the fourth interval of twist z is about 0.67 inches. In one of many embodiments, the first, second, third and fourth ranges of values for the first, second, third and fourth intervals of twisted extend +/−0.05 inches from the mean value for the respective range, as summarized in the table below:

| Pair No. | Mean Twist Length | Lower Limit of Twist Length | Upper Limit of Twist Length |
|---|---|---|---|
| 3/51 | 0.440 | 0.390 | 0.490 |
| 5/53 | 0.410 | 0.360 | 0.460 |
| 7/55 | 0.596 | 0.546 | 0.646 |
| 9/57 | 0.670 | 0.620 | 0.720 |

By purposefully varying the intervals of twist w, x, y, z along the length of the cabling media 1, 44, it is possible to reduce internal near end crosstalk (NEXT) and alien near end crosstalk (ANEXT) to an acceptable level, even at high speed data bit transfer rates over the first cable 1.

FIGS. 7–10 illustrate the ANEXT for the first cable 1 having the variable intervals of twist w, x, y, z, residing within the ranges outlined in the table above. To obtain the data of FIG. 7, the output of the VNA is connected to pair 51 of the second cable 44 while the input of the VNA is connected to pair 3 of the first cable 1. The VNA is used to sweep over a band of frequencies from 0.500 MHz to 1000 MHz and the ratio of the signal strength detected on pair 3 of the first cable 1 over the signal strength applied to pair 51 of the second cable 44 is captured. This is the ANEXT contributed to pair 3 in the first cable 1 from pair 51 in the second cable 44. Contributions to pair 3 in the first cable 1 from pairs 53, 55 and 57 in the second cable 44 are acquired in the same manner. The power sum of contributions from pairs 51, 53, 55 and 57 in the second cable 44 to pair 3 in the first cable 1 is the ANEXT contributed to pair 3 in the first cable 1 due to all the pairs in the second cable 44 and is displayed as the trace 30 in FIG. 7 on a logarithmic scale. The above procedure is repeated for the second, third and fourth twisted wire pairs 5, 7, 9 in the first cable 1 to arrive at the ANEXT traces 32, 34, 36 for the second, third and fourth twisted wire pairs 5, 7, 9, respectively, due to contributions from pairs 51, 53, 55 and 57 in the second cable 44.

The graphs of FIGS. 7–10 illustrate the ANEXT for frequencies between 0.500 MHz to 1000 MHz. A reference line 38 described by the function 44.3–15*log(f/100) dB where f is in the units of MHz is included in FIGS. 7–10 and serves as a reference above which potentially acceptable ANEXT performance is achieved. The reference line 38 is identically located on the graphs of FIGS. 7–10, as compared to the reference line F of FIGS. 2–5. As can be seen in FIGS. 7–10, the ANEXT for the cabling media 1 of the present invention shows positive margin above the acceptable ANEXT levels for accurate data transmission across the various data transmission speeds tested. This crosstalk reduction is relatively remarkable, as compared to the corresponding performance characteristics of the cabling media of the background art, as illustrated in FIGS. 2–5.

A breakthrough of the present invention is the discovery that by the purposefully varying or modulating the twist intervals w, x, y, z, the interference signal coupling between adjacent cables is randomized. In other words, assume a first signal passes along a twisted wire pair from one end to another end of a cable, and the twisted wire pair has a randomized, or at least varying, twist pattern. It is highly unlikely that an adjacent second signal, passing along another twisted wire (whether within the same cable or within a different cable), will travel for any significant distance alongside the first signal in a same or similar twist pattern. Because the two adjacent signals are traveling within adjacent twisted wire pairs having different varying twist patterns, any interference coupling between the two adjacent twisted wire patterns is greatly reduced.

It should be noted that the interference reduction benefits of varying the twist patterns of the twisted wire pairs can be combined with the tight twist intervals disclosed in Applicants' co-pending application entitled "TIGHTLY TWISTED WIRE PAIR ARRANGEMENT FOR CABLING MEDIA," incorporated by reference above. Under such circumstances, the interference reduction befits of the present invention are even more greatly enhanced. For example the first, second, third and fourth mean values for the first, second, third and fourth twist intervals w, x, y, z may be set at 0.44 inches, 0.32 inches, 0.41 inches, and 0.35 inches, respectively.

The present invention has determined at least one set of ranges for the values of the variable twist intervals w, x, y, z, which greatly improves the alien NEXT performance, while maintaining the cable within the specifications of standardized cables and enabling an overall cost-effective production of the cabling media. In the embodiment set forth above, the twist length of each of four pairs is purposefully varied approximately +/−0.05 inches from the respective twisted pair's twist length's mean value. Therefore, each twist length is set to purposefully vary about +/−(7 to 12) % from the mean value of the twist length. It should be appreciated that this is only one embodiment of the invention. It is within the purview of the present invention that more or less twisted wire pairs may be included in the cable 1 (such as two pair, twenty five pair, or one hundred pair type cables). Further, the mean values of the twist lengths of respective pairs may be set higher or lower. Even further, the purposeful variation in the twist length may be set higher or lower (such as +/−0.15 inches, +/−0.25 inches, +/−0.5 inches or even +/−1.0 inch, or alternately stated the ratio of purposeful variation in the twist length to mean twist length could be set at various ratios such as 20%, 50% or even 75%).

Heretofore, it was believed that it would be necessary to overall shield the twisted wire pairs 3, 5, 7, 9 within the jacket 2 in order to achieve the necessary alien NEXT reduction at the higher frequencies of data transmission. Overall shielding of the twisted wire pairs 3, 5, 7, 9 would result in an expensive cabling media and would lead to complexity in connectivity and installation. By the present invention, the jacket 2 need not include a shielding layer in order to have a reduced alien NEXT. Therefore, the cabling media of the present invention shows a vast improvement by producing a cabling media with an acceptable alien NEXT response at a lower cost than previously thought possible.

Figure 11:
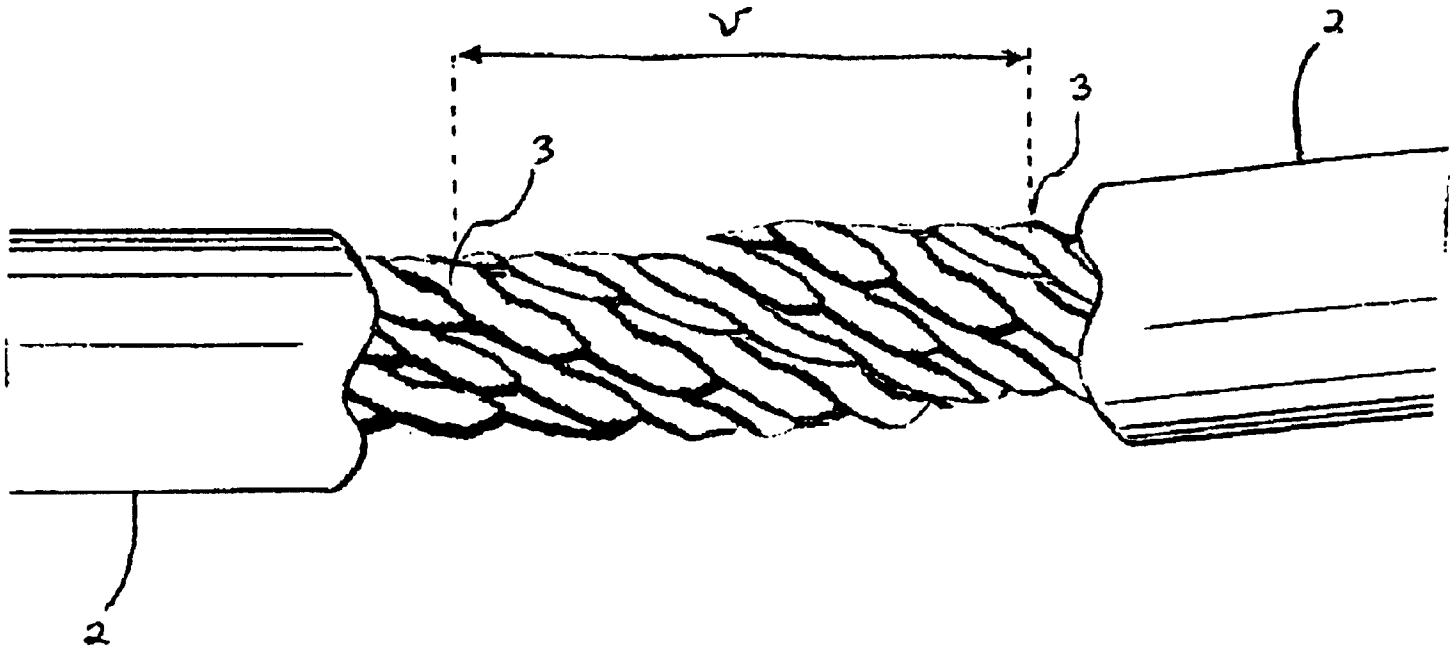
FIG. 11 is a perspective view of a midsection of the cabling media of FIG. 6, with the jacket removed to show a core strand twist interval.
Figure 12:
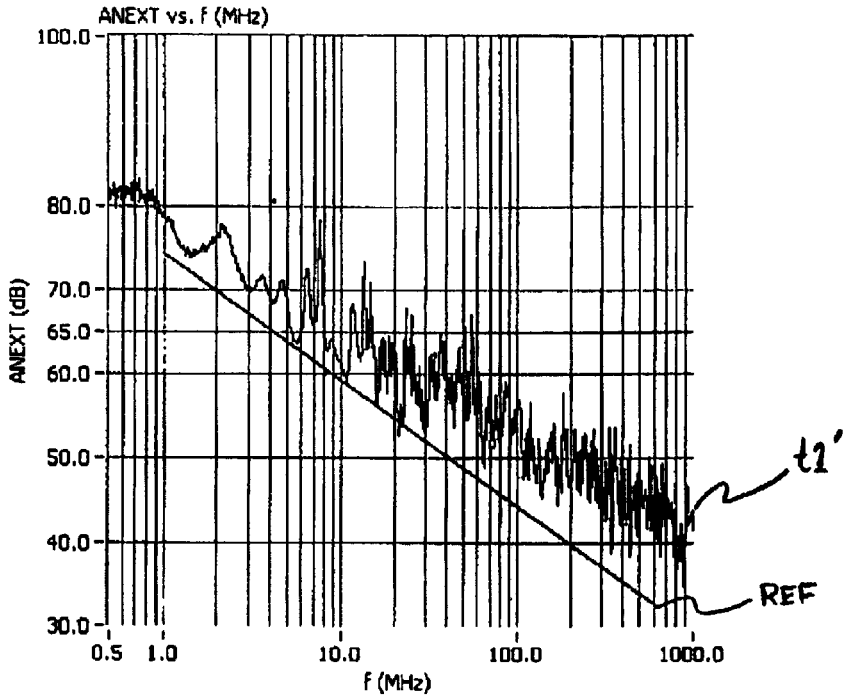
FIG. 12 is a graph illustrating ANEXT performance for the first pair 3, when the twisted wire pairs are held at respective constant twist lengths and the core strand length/lay is purposefully varied along the length of the cabling media.
Figure 13:
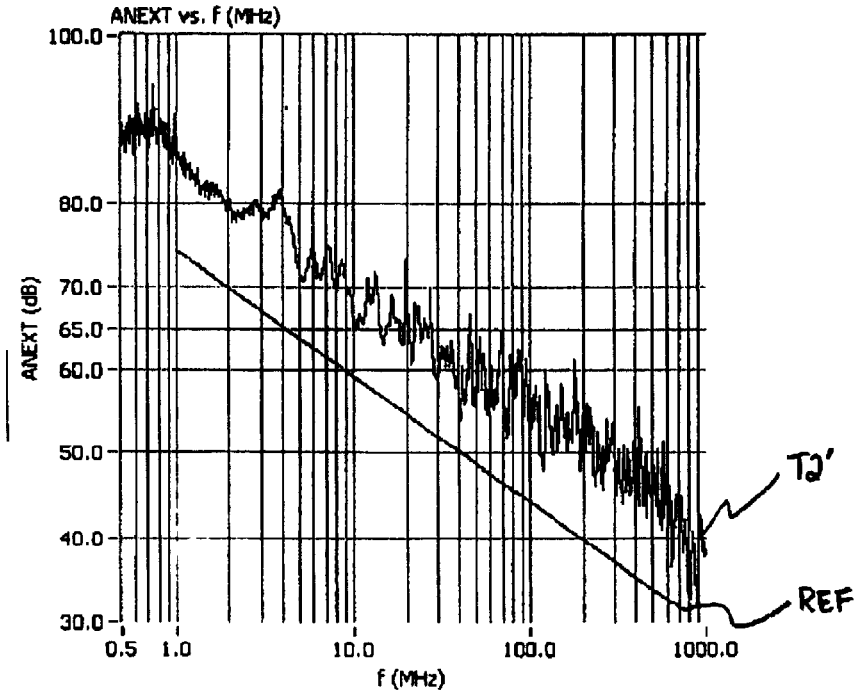
FIG. 13 is a graph illustrating ANEXT performance for the second pair 5, when the twisted wire pairs are held at respective constant twist lengths and the core strand length/lay is purposefully varied along the length of the cabling media.
Figure 14:
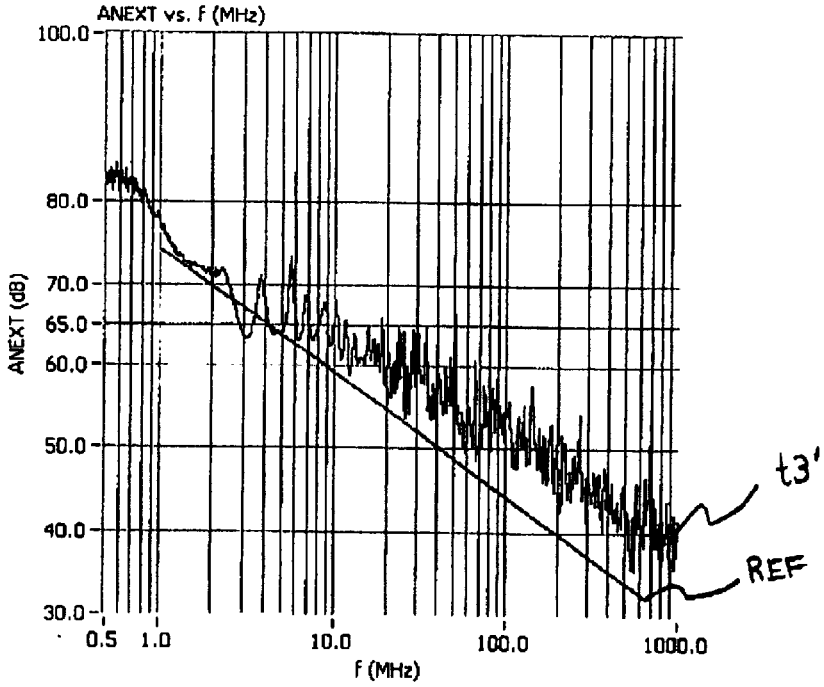
FIG. 14 is a graph illustrating ANEXT performance for the third pair 7, when the twisted wire pairs are held at respective constant twist lengths and the core strand length/lay is purposefully varied along the length of the cabling media.
Figure 15:
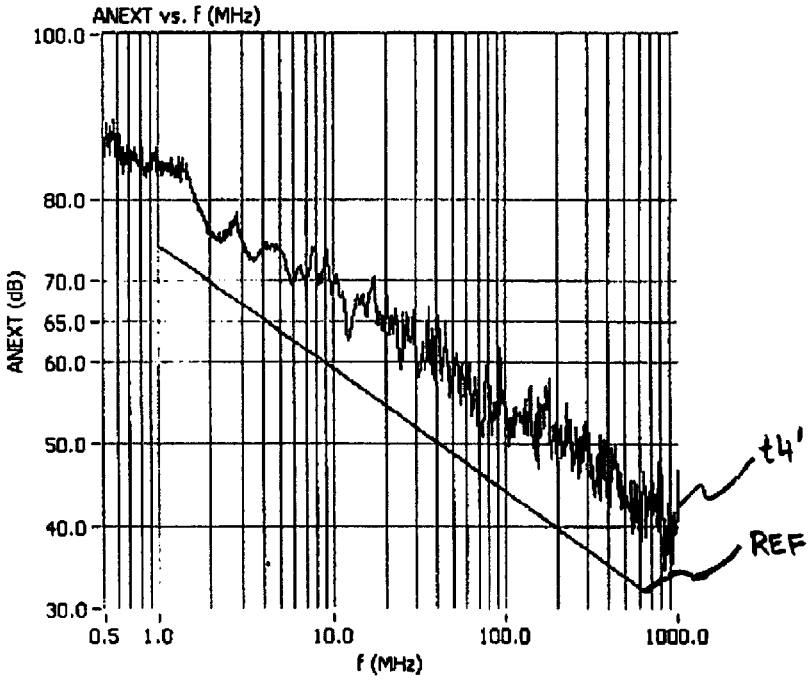
FIG. 15 is a graph illustrating ANEXT performance for the fourth pair 9, when the twisted wire pairs are held at respective constant twist lengths and the core strand length/lay is purposefully varied along the length of the cabling media.
Figure 16:
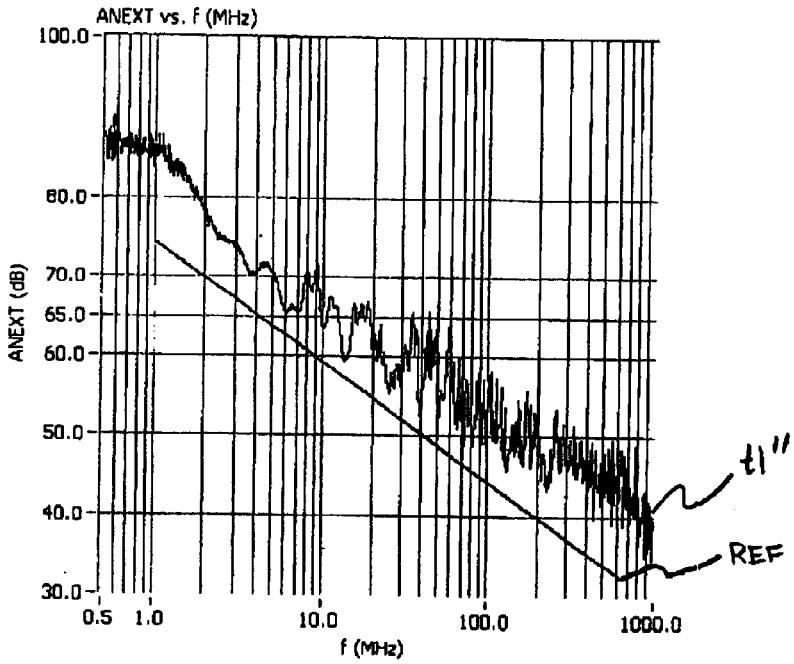
FIG. 16 is a graph illustrating ANEXT performance for the first pair 3, when the twisted wire pairs' twist lengths are purposefully varied and the core strand length/lay is purposefully varied along the length of the cabling media.
Figure 17:
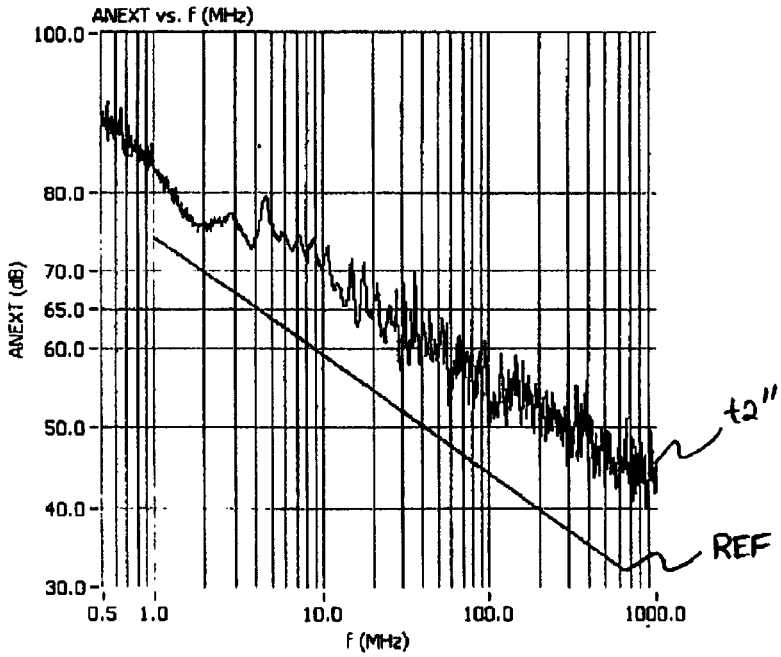
FIG. 17 is a graph illustrating ANEXT performance for the second pair 5, when the twisted wire pairs' twist lengths are purposefully varied and the core strand length/lay is purposefully varied along the length of the cabling media.
Figure 18:
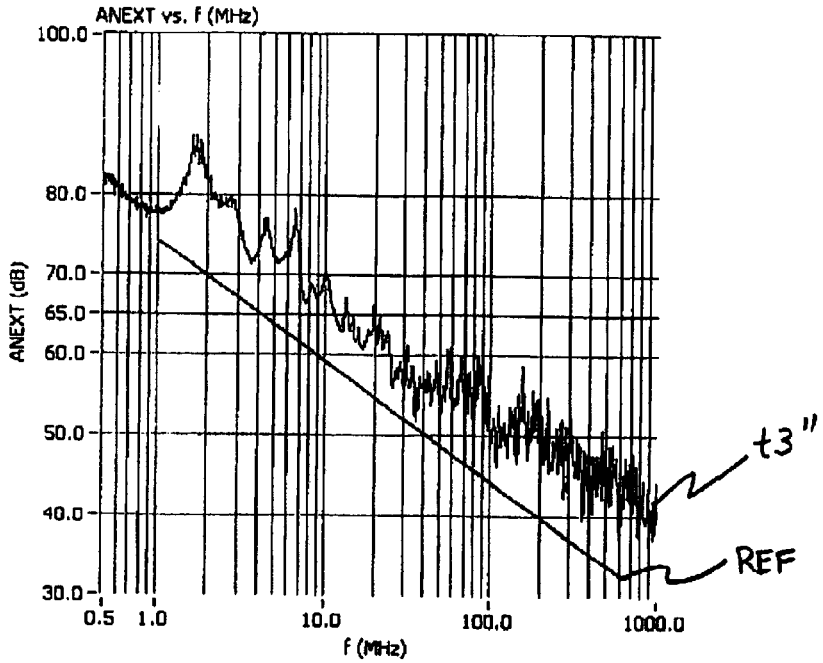
FIG. 18 is a graph illustrating ANEXT performance for the third pair 7, when the twisted wire pairs' twist lengths are purposefully varied and the core strand length/lay is purposefully varied along the length of the cabling media.
Figure 19:
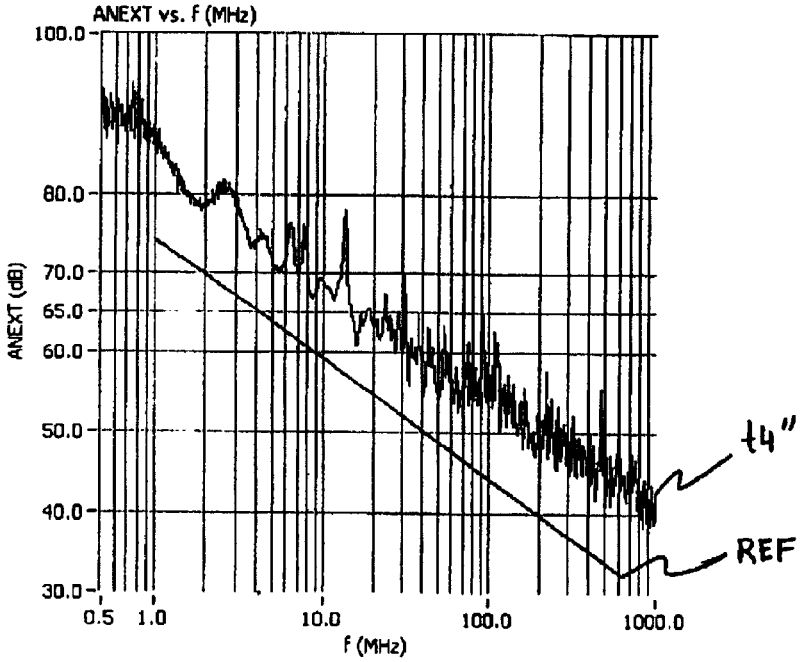
FIG. 19 is a graph illustrating ANEXT performance for the fourth pair 9, when the twisted wire pairs' twist lengths are purposefully varied and the core strand length/lay is purposefully varied along the length of the cabling media.

FIG. 11 is a perspective view of a midsection of the first cable 1 of FIG. 6, with the jacket 2 removed. FIG. 11 reveals that the first, second, third and fourth twisted wire pairs 3, 5, 7, 9 are continuously twisted about each other along the length of the first cable 1. The first, second, third and fourth twisted wire pairs 3, 5, 7, 9, twist completely about each other, three hundred sixty degrees, at a purposefully varied core stand length interval v along the length of the cabling media 1. In a preferred embodiment, the core strand length interval v has a mean value of about 4.4 inches, and ranges between 1.4 inches and 7.4 inches along the length of the cabling media. The varying of the core strand length can also be random or based upon an algorithm.

The purpose of twisting the twisted wire pairs 3, 5, 7, 9 about each other is to further reduce alien NEXT and improve mechanical cable bending performance. As is understood in the art, the Alien NEXT represents the induction of crosstalk between a twisted wire pair of a first cabling media (e.g. the first cable 1) and another twisted wire pair of a "different" cabling media (e.g. the second cable 44). Alien crosstalk can become troublesome where multiple cabling media are routed along a common path over a substantial distance. For example, multiple cabling media are often passed through a common conduit in a building.

By the present invention, the core strand length interval v is purposefully varied along the length of the cabling media. By varying the core strand length interval v along the length of the cabling media, alien NEXT is further reduced, as will be demonstrated by the graphs of FIGS. 12–15 discussed below.

FIGS. 12–15 are graphs illustrating ANEXT performance for pairs 3, 5, 7 and 9 in cable 1 of the present invention, where the twist length of the pairs 3, 5, 7, 9 is not purposefully varied, but the core strand length is purposefully varied between 1.4 inches and 7.4 inches. In other words, the pairs 3, 5, 7, 9 have fixed twisted lengths of 0.440, 0.410, 0.596 and 0.670, respectively, as is common in the background art. However, in the background art, the core strand length is fixed at 4.4 inches along the length of the cabling media. By the present invention, the core strand length is purposefully varied along the length of the cabling media.

The ANEXT performance of the cable 1, constructed as set forth above, should be compared to the background art's cable performance, as illustrated in FIGS. 2–5. Particularly, the traces t1', t2', t3' and t4' characterizing the twisted wire pairs 3, 5, 7 and 9, respectively, show notable improvements in the reduction of ANEXT as compared to the traces t1, t2, t3 and t4 of the twisted wire pairs A, B, C and D, respectively, of the background art. The notable improvement in ANEXT reduction is attributed to the present invention's purposeful variation in the core strand length.

FIGS. 16–19 are graphs illustrating ANEXT performance for pairs 3, 5, 7 and 9 in cable 1 of the present invention, when the twist length of the pairs 3, 5, 7, 9 is purposefully varied, and the core strand length is purposefully varied between 1.4 inches and 7.4 inches. In other words, the pairs 3, 5, 7, 9 have purposefully varying twist lengths with mean values of 0.440, 0.410, 0.596 and 0.670, respectively, as was described in conjunction with FIGS. 7–10, above. Moreover, the core strand length is set to purposefully vary between 1.4 and 7.4 inches.

The reduction in ANEXT of the cable 1, constructed as set forth above, can be seen in the traces t1", t2", t3" and t4". The traces t1", t2", t3" and t4" should be compared to the traces t1, t2, t3 and t4 of FIGS. 2–5, which characterize the performance of the background art's cable E. It can be seen that a very remarkable improvement in the reduction of ANEXT can be attributed to combining the two aspects of the present invention. Specifically, ANEXT is greatly reduced when one combines the benefits of varying the core strand length along the cabling media, in combination with varying the twist lengths of the twisted pairs along the cabling media.

As disclosed above, a cabling media constructed in accordance with the present invention shows a high level of immunity to alien NEXT, which translates into a cabling media capable of faster data transmission rates and a reduced likelihood of data transmission errors. The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A cabling media comprising:

a first twisted wire pair including first and second conductors, each separately surrounded by an insulation, wherein the first conductor and the second conductor are continuously twisted about each other along a length of the cabling media, and wherein the first conductor and the second conductor twist completely about each other, three hundred sixty degrees, at a first interval which varies along the length of the cabling media;

a second twisted wire pair including third and fourth conductors, each separately surrounded by an insulation, wherein the third conductor and the fourth conductor are continuously twisted about each other along the length of the cabling media, and wherein the third conductor and the fourth conductor twist completely about each other, three hundred sixty degrees, at a second interval which varies along the length of the cabling media;

a third twisted wire pair including fifth and sixth conductors, each separately surrounded by an insulation, wherein the fifth conductor and the sixth conductor are continuously twisted about each other along the length of the cabling media, and wherein the fifth conductor and the sixth conductor twist completely about each other, three hundred sixty degrees, at a third interval which varies along the length of the cabling media; and a fourth twisted wire pair including seventh and eighth conductors, each separately surrounded by an insulation, wherein the seventh conductor and the eighth conductor are continuously twisted about each other along the length of the cabling media, and wherein the seventh conductor and the eighth conductor twist completely about each other, three hundred sixty degrees, at a fourth interval which varies along the length of the cabling media, wherein the first interval varies in length within a first range of values, the second interval varies in length within a second range of values, the third interval varies in length within a third range of values, and the fourth interval varies in length within a fourth range of values, wherein the first range of values has a first mean value, the second range of values has a second mean value, the third range of values has a third mean value, and the fourth range of values has a fourth mean value, and wherein the first mean value is different than the second mean value.

2. The cabling media according to claim 1, wherein the first range of values is different than the second, third and fourth ranges of values.

3. The cabling media according to claim 2, wherein the second range of values is different than the third and fourth ranges of values.

4. The cabling media according to claim 3, wherein the third range of values is different than the fourth range of values.

5. The cabling media according to claim 1, wherein the first mean value is approximately 0.44 inches.

6. The cabling media according to claim 5, wherein the second mean value is approximately 0.41 inches.

7. The cabling media according to claim 6, wherein the third mean value is approximately 0.59 inches.

8. The cabling media according to claim 7, wherein the fourth mean value is approximately 0.67 inches.

9. The cabling media according to claim 1, wherein the first range of values varies within approximately +/−0.05 inches from the first mean value of the first range of values.

10. The cabling media according to claim 9, wherein the second range of values varies within approximately +/−0.05 inches from the second mean value of the second range of values, the third range of values varies within approximately +/−0.05 inches from the third mean value of the third range of values, and the fourth range of values varies within approximately +/−0.05 inches from the fourth mean value of the fourth range of values.

11. The cabling media according to claim 1, wherein the first range of values resides between about 0.39 inches and about 0.49 inches.

12. The cabling media according to claim 11, wherein the second range of values resides between about 0.36 inches and about 0.46 inches, the third range of values resides between about 0.54 inches and about 0.64 inches, and the fourth range of values resides between about 0.62 inches and about 0.72 inches.

13. The cabling media according to claim 1, wherein the first, second, third and fourth twisted wire pairs are continuously twisted about each other along the length of the cabling media, and wherein the first, second, third and fourth twisted wire pairs twist completely about each other, three hundred sixty degrees, at a fifth interval which varies along the length of the cabling media, and wherein the fifth interval varies in length within a fifth range of values.

14. The cabling media according to claim 13, wherein the fifth range of values has a fifth mean value of approximately 4.4 inches.

15. The cabling media according to claim 13, wherein the fifth range of values varies within approximately +/−3.0 inches from a fifth mean value of the fifth range of values.

16. The cabling media according to claim 13, wherein the fifth range of values resides between about 1.4 inches and about 7.4 inches.

17. The cabling media according to claim 1, wherein the first, second, third and fourth twisted wire pairs do not include individual shielding layers to shield each from the other.

18. The cabling media according to claim 1, further comprising:

a jacket surrounding the first, second, third and fourth twisted wire pairs.

19. The cabling media of claim 18, wherein the first through eighth conductors are metallic conductors including copper and are twenty-four gauge.

20. The cabling media of claim 1, wherein the cabling media meets the specifications of CAT 5, CAT 5*e* or CAT 6 cabling.

21. The cabling media of claim 1, further comprising:

fifth through twenty-fifth twisted wire pairs, each twisted pair including a pair of conductors and each conductor separately surrounded by an insulation, wherein the respective pairs of conductors are continuously twisted about each other along a length of the cabling media, and wherein the respective pairs of conductors twist completely about each other, three hundred sixty degrees, at respective fifth through twenty-fifth intervals which vary along the length of the cabling media.

22. A method of making a cabling media comprising the steps of:

providing first and second conductors, each separately surrounded by an insulation;

continuously twisting the first and second conductors about each other to form a length of a first twisted wire pair, wherein the first conductor and the second conductor are twisted completely about each other, three hundred sixty degrees, at a varying first interval along the length of the first twisted wire pair;

providing third and fourth conductors, each separately surrounded by an insulation;

continuously twisting the third and fourth conductors about each other to form a length of a second twisted wire pair, wherein the third conductor and the fourth conductor are twisted completely about each other, three hundred sixty degrees, at a varying second interval along the length of the second twisted wire pair;

providing fifth and sixth conductors, each separately surrounded by an insulation;

continuously twisting the fifth and sixth conductors about each other to form a length of a third twisted wire pair, wherein the fifth conductor and the sixth conductor are twisted completely about each other, three hundred sixty degrees, at a varying third interval along the length of the third twisted wire pair;

providing seventh and eighth conductors, each separately surrounded by an insulation; and continuously twisting the seventh and eighth conductors about each other to form a length of a fourth twisted wire pair, wherein the seventh conductor and the eighth conductor are twisted completely about each other, three hundred sixty degrees, at a varying fourth interval along the length of the fourth twisted wire pair, wherein the first interval varies in length within a first range of values, the second interval varies in length within a second range of values, the third interval varies in length within a third range of values, and the fourth interval varies in length within a fourth range of values, wherein the first range of values has a first mean value, the second range of values has a second mean value, the third range of values has a third mean value, and the fourth range of values has a fourth mean value, and wherein the first mean value is different than the second mean value.

23. The method according to claim 22, wherein the first range of values is different than the second, third and fourth ranges of values.

24. The method according to claim 23, wherein the second range of values is different than the third and fourth ranges of values, and the third range of values is different than the fourth range of values.

25. The method according to claim 22, wherein the first mean value is approximately 0.44 inches.

26. The method according to claim 25, wherein the second mean value is approximately 0.41 inches, the third mean value is approximately 0.59 inches, and the fourth mean value is approximately 0.67 inches.

27. The method according to claim 22, wherein the first range of values vary within approximately +/−0.05 inches from the first mean value of the first range of values.

28. The method according to claim 27, wherein the second range of values vary within approximately +/−0.05 inches from the second mean value of the second range of values, the third range of values vary within approximately +/−0.05 inches from the third mean value of the third range of values, and the fourth range of values vary within approximately +/−0.05 inches from the fourth mean value of the fourth range of values.

29. The method according to claim 22, wherein the first range of values resides between about 0.39 inches and about 0.49 inches.

30. The method according to claim 29, wherein the second range of values resides between about 0.36 inches and about 0.46 inches, the third range of values resides between about 0.54 inches and about 0.64 inches, and the fourth range of values resides between about 0.62 inches and about 0.72 inches.

31. The method according to claim 22, further comprising the steps of:

continuously twisting the first, second, third and fourth twisted wire pairs about each other along the length of the cabling media, wherein the first, second, third and fourth twisted wire pairs are twisted completely about each other, three hundred sixty degrees, at a varying fifth interval along the length of the cabling media, wherein the fifth interval varies in length within a fifth range of values.

32. The method according to claim 31, wherein the fifth range of values has a fifth mean value of approximately 4.4 inches.

33. The method according to claim 31, wherein the fifth range of values varies within approximately +/−3.0 inches from a fifth mean value of the fifth range of values.

34. The method according to claim 31, wherein the fifth range of values resides between about 1.4 inches and about 7.4 inches.

35. A cabling media comprising:

a plurality of conductor-pairs, each of said conductor-pairs including two metallic conductors each separately surrounded by an insulation and which along essentially the entire length of the cable media are twisted together in accordance with a twist scheme including a first pair having a twist length varying by at least +/−0.01 inches about a first mean value along the length of the cabling media; a second pair having a twist length varying by at least +/−0.01 inches about a second mean value along the length of the cabling media; a third pair having a twist length varying by at least +/−0.01 inches about a third mean value along the length of the cabling media; and a fourth pair having a twist length varying by at least +/−0.01 inches about a fourth mean value along the length of the cabling media; and a jacket enclosing said plurality of conductor-pairs, wherein the first mean value is different than the second mean value.

36. The cabling media of claim 35, wherein said plurality of conductor-pairs are twisted together to form a core.

37. The cabling media of claim 36, wherein said core has a twist length which varies by at least +/−0.01 inches along the length of the cabling media.

38. The cabling media of claim 35, wherein the cabling media meets the specifications of CAT 5, CAT 5*e* or CAT 6 cabling.

39. A cabling media comprising:

a plurality of conductor-pairs, each of said conductor-pairs including two metallic conductors each separately surrounded by an insulation and which along essentially the entire length of the cable media are twisted about each other in accordance with a twist scheme, wherein:

a first of the conductor pairs has a twist length, defined as a length along the cabling media during which the two conductors of the first conductor-pair twist completely about each other, three hundred sixty degrees, which varies along the length of the cabling media about a first mean value; and a second of the conductor pairs has a twist length, defined as a length along the cabling media during which the two conductors of the second conductor-pair twist completely about each other, three hundred sixty degrees, which varies along the length of the cabling media about a second mean value; and a jacket enclosing the plurality of conductor-pairs, wherein the first mean value is different than the second mean value.

40. The cabling media according to claim 39, wherein at least three of the conductor pairs have twist lengths which vary along the length of the cabling media.

41. A cabling media comprising:

a first twisted wire pair including first and second conductors, each separately surrounded by an insulation, wherein the first conductor and the second conductor are continuously twisted about each other along a length of the cabling media, and wherein the first conductor and the second conductor twist completely about each other, three hundred sixty degrees, at a first interval along the length of the cabling media; and a second twisted wire pair including third and fourth conductors, each separately surrounded by an insulation, wherein the third conductor and the fourth conductor are continuously twisted about each other along the length of the cabling media, and wherein the third conductor and the fourth conductor twist completely about each other, three hundred and sixty degrees, at a second interval along the length of the cabling media, wherein the first and second twisted wire pairs are continuously twisted about each other along the length of the cabling media, and wherein the first and second twisted wire pairs twist completely about each other, three hundred sixty degrees, at a core strand interval which varies along the length of the cabling media.

42. The cabling media according to claim 41, wherein the core strand interval varies in length within a core strand interval range of values, and wherein the core strand interval range of values has a mean value of approximately 4.4 inches.

43. The cabling media according to claim 41, wherein the core strand interval varies in length within a core strand range of values, and wherein the core strand range of values varies within approximately +/−3.0 inches from a core strand mean value of the core strand range of values.

44. The cabling media according to claim 41, wherein the core strand interval varies in length within a core strand range of values, and wherein the core strand range of values resides between about 1.4 inches and about 7.4 inches.

* * * * *